US007413105B1

(12) United States Patent
Ho et al.

(10) Patent No.: US 7,413,105 B1
(45) Date of Patent: Aug. 19, 2008

(54) PUSHING DEVICE OF DRAWER TYPE MAGAZINE FOR NAIL GUN

(75) Inventors: Yu-Chuan Ho, Dali (TW); Hsien-Nung Liu, Sindian (TW)

(73) Assignee: Apach Industrial Co., Ltd., Taichung (TW)

( * ) Notice: Subject to any disclaimer, the term of this patent is extended or adjusted under 35 U.S.C. 154(b) by 0 days.

(21) Appl. No.: 11/723,792

(22) Filed: Mar. 22, 2007

(51) Int. Cl.
*B25C 1/04* (2006.01)

(52) U.S. Cl. ..... 227/120; 227/136

(58) Field of Classification Search ..... 227/120, 227/109, 136, 119
See application file for complete search history.

(56) References Cited

U.S. PATENT DOCUMENTS 4,197,974 A * 4/1980 Morton et al. ..... 227/8
5,322,189 A * 6/1994 Oda ..... 221/227
6,056,181 A * 5/2000 Chuang ..... 227/8
6,199,739 B1 * 3/2001 Mukoyama et al. ..... 227/8
6,290,115 B1 * 9/2001 Chen ..... 227/120
6,431,428 B1 * 8/2002 Chen ..... 227/120
6,641,022 B2 * 11/2003 Hamano et al. ..... 227/120
6,938,809 B1 * 9/2005 Schnell ..... 227/8
7,028,875 B1 * 4/2006 Beville et al. ..... 227/8
7,175,064 B2 * 2/2007 Schell et al. ..... 227/120
7,240,818 B1 * 7/2007 Ho ..... 227/109
7,284,685 B1 * 10/2007 Wojcicki ..... 227/119

* cited by examiner

*Primary Examiner*—Scott A. Smith
(74) *Attorney, Agent, or Firm*—Banger Shia

(57) ABSTRACT

The present invention refers to a pushing device of a drawer type magazine apparatus, especially for use with nail guns, in which the magazine apparatus is coupled to a barrel and includes a magazine unit. The magazine unit is equipped with a fixed magazine and a removable nail loading assembly, which cooperates with a pushing device and a nail pusher. The pushing device is equipped with an accommodating member and a spiral spring, by means of the cooperation of the accommodating member and the spiral spring of the pushing device and the nail pusher, the nails can be pushed precisely and stably with an average thrust, so that the situation of nails slanting or getting nails stuck will not happen. The objectives of promoting the convenience for operators and providing durable nail guns are achieved.

9 Claims, 3 Drawing Sheets

PUSHING DEVICE OF DRAWER TYPE MAGAZINE FOR NAIL GUN

FIELD OF THE INVENTION

The present invention generally relates to the field of nail guns, and more particularly to a pushing device of a drawer type magazine apparatus for use in nail guns.

BACKGROUND OF THE INVENTION

Conventional depth adjusting devices of nail guns are generally installed inside the safety device, for example, TW Appl. No. 82216782 and 83214893 disclose a magazine that includes a nail loading frame and a nail pusher which are formed in one piece with plastic. The spring of the nail pusher is a conventional coil spring for a pushing member to push nails. However, the replacement of the integral structure is inconvenient and the conventional spring has many shortcomings that cause inconvenience for the operator.

SUMMARY OF THE INVENTION

The objective of the present invention is to provide a magazine with a pushing device for use in a nail gun, in which a magazine apparatus coupled to the barrel includes a fixed magazine and a removable nail loading assembly, which cooperates with a pushing device and a nail pusher. The pushing device includes an accommodating member for engaging with a spiral spring and an engaging member and cooperates with the nail pusher to push nails. Due to the cooperation of the pushing device and the nail pusher, the magazine apparatus of the nail gun uses an average thrust to push the nails toward the barrel, so that the situation of nails slanting or getting nails stuck will not be happen, and the objective of improvement the stability of the nail gun is achieved.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
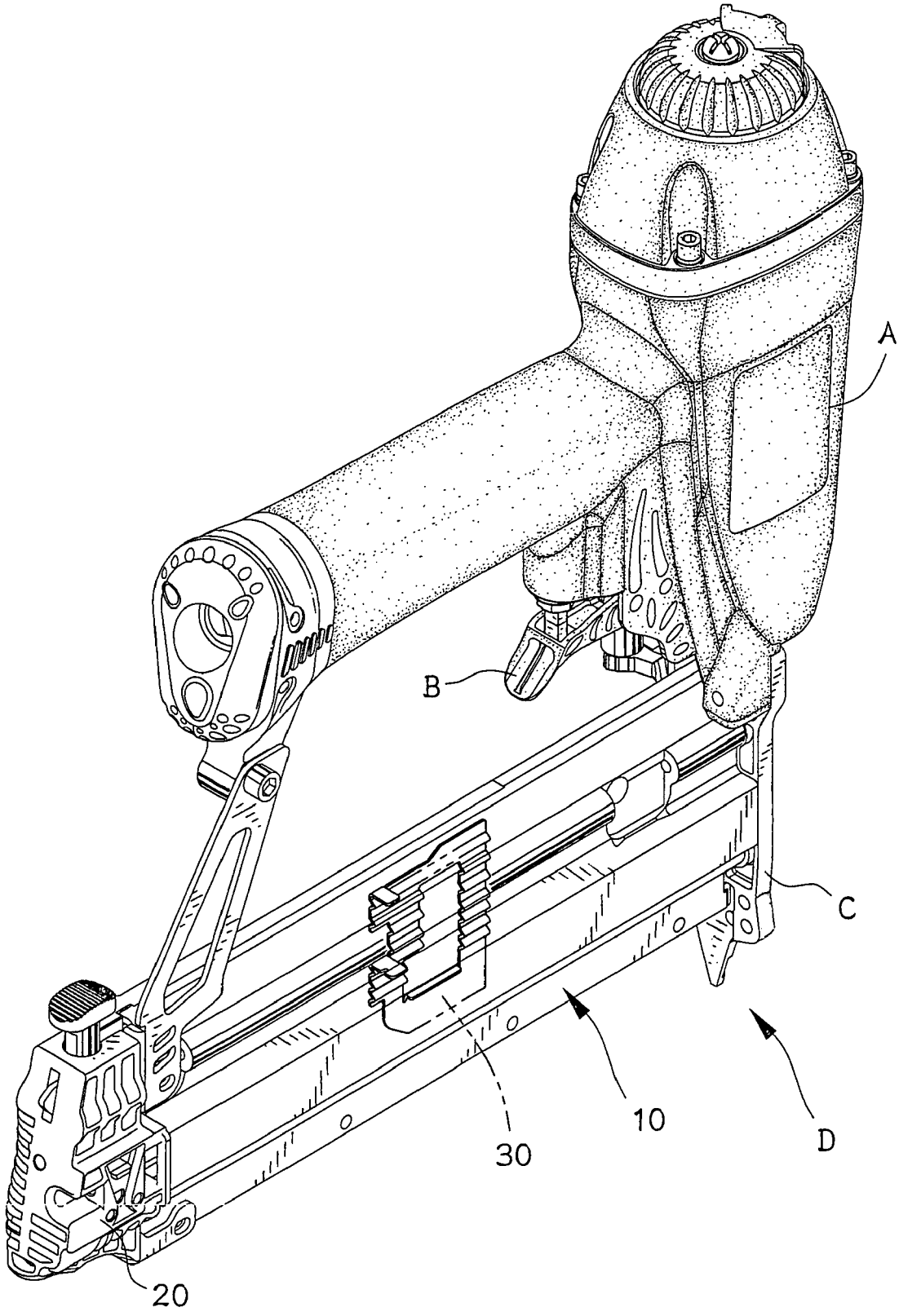
FIG. 1 is a perspective view of the present invention.

Referring to FIG. 1, the present invention refers to a typical nail gun, a main body A of the nail gun is equipped with a magazine apparatus D disposed between a trigger B and a barrel C. The magazine apparatus D includes a magazine unit 10 that is equipped with a pushing device 20 and a nail pusher 30. With the cooperation of the pushing device 20 and the nail pusher 30 inside the magazine unit 10, the nails inside the magazine unit 10 are pushed by an average thrust so that the situation of nails slanting or getting nails stuck will not be come across to.

Figure 2:
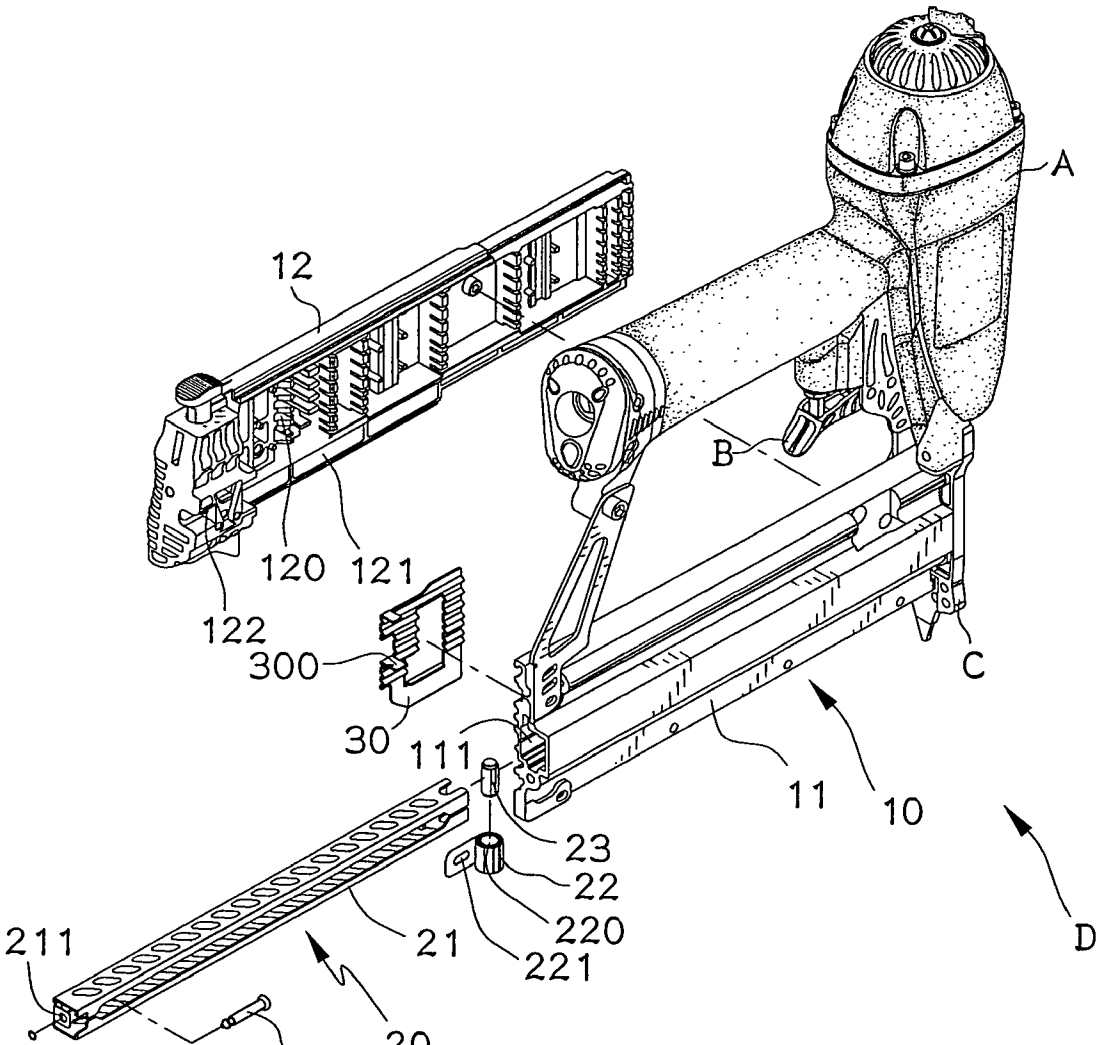
FIG. 2 is an exploded view of the present invention.
Figure 3:
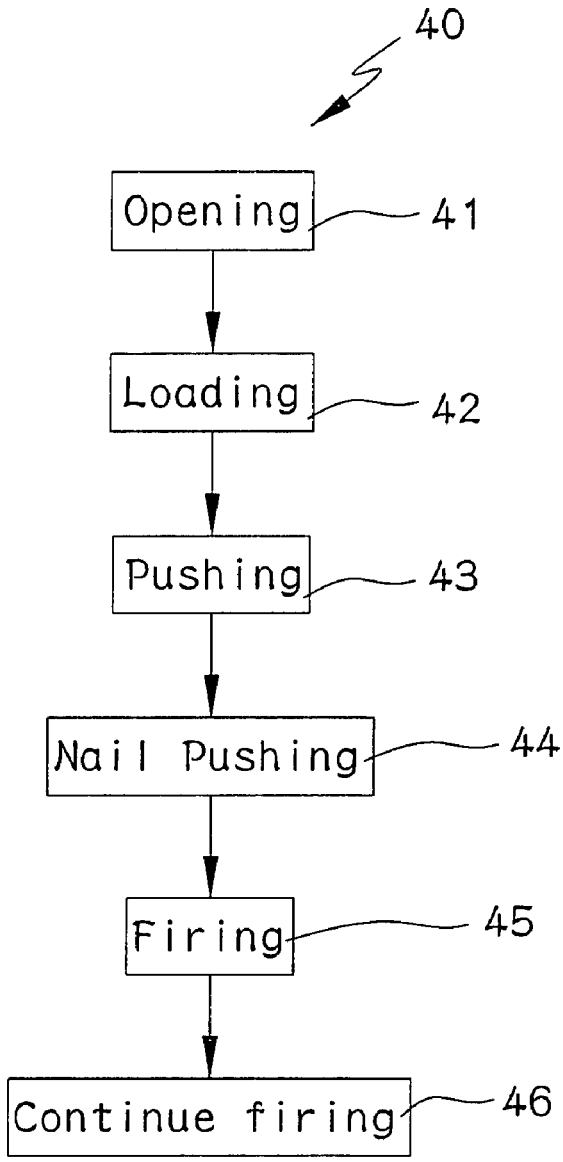
FIG. 3 is a flow chart of the present invention.

Referring to FIG. 2, the magazine unit 10 includes a fixed magazine 11 that is in the form of integrated multi-layers and coupled to the barrel C, and a removable nail loading assembly 12 slidablly connected therewith. The fixed magazine 11 includes an elongated groove of guide part 110 and a receiving part 111 of many dents implemented relatively to the removable nail loading assembly 12. The lowest portion of the receiving part 111 is provided with an inserting part 1110 for receiving the pushing device 20 and the nail pusher 30. The removable nail loading assembly 12 includes a rugged cooperating part 120, a recessed accommodating part 121 that is lower than the cooperating part 120, and a round lock hole 122. The cooperating part 120 is connected slidablly with the receiving part 111 of the fixed magazine 11, and the accommodating part 121 and the lock hole 122 are for accommodating and engaging with the pushing device 20.

The pushing device 20 includes an accommodating member 21 in the form of hollow rectangular bar, a spiral spring 22, a cylindrical engaging member 23 and a fastener 24 for fixing therewith. The accommodating member 21 has an U-shaped engaging end 210 for engaging with the engaging member 23 and a penetrating end 211 in the form of a slat with a round end on one side for the fastener 24 to pass through. The spiral spring 22 has a round penetrating aperture 220 for receiving the engaging member 23, and a long groove of fixing part 221 for engaging with the nail pusher 30. The engaging member 23 is inserted into the spiral spring 22 and includes two opposite locking ends 230 for locking on the engaging end 210 of the accommodating member 21. The fastener 24 is inserted into the lock hole 122 of the removable nail loading assembly 12 and the penetrating end 211 of the accommodating member 21 and locks them together.

The nail pusher 30 corresponds with the figure of the receiving part 111 and includes two opposite protrusions 300 at one side of the nail pusher 30. The protrusions 300 are inserted into the inserting part 1110 of the receiving part 111 and the fixing part 221 of the spiral spring 22.

The nail pushing motion 40 about the drawer type magazine apparatus is as shown in FIG. 4.

Opening 41: the operator presses a release button and then pulls the removable nail loading assembly 12 together with the pushing device 20, the spiral spring 22 and the nail pusher 30 out of the fixed magazine 11 away from the barrel C.

Loading 42: the operator places the nails into the receiving part 111 and then pushes the nails gently toward the barrel C.

Pushing 43: the operator pushes the removable nail loading assembly 12 toward the barrel C.

Nail Pushing 44: the nail pusher 30 pushes the nails to the shooting part of the barrel C by means of the spiral spring 22 engaged with the accommodating member 21 of the pushing device 20 providing the average thrust.

Firing 45: the operator presses the trigger B to drive the nails inside the magazine unit 10 out of the barrel C into the work object.

Continue firing 46: the operator repeats the action all over again.

While we have shown and described the embodiment in accordance with the present invention, it should be clear to those skilled in the art that further embodiments may be made without departing from the scope of the present invention.

What is claimed is:

1. A pushing device of a drawer type magazine apparatus for use with a nail gun comprising:

a magazine unit including a fixed magazine coupled with a barrel, and a removable nail loading assembly;

a pushing device including an accommodating member accommodated inside an accommodating part of the removable nail loading assembly, a spiral spring disposed on one end of said accommodating member and cooperated with a nail pusher, an engaging member inserted into said spiral spring and locked on one end of said accommodating member and a fastener inserted to a lock hole of said removable nail loading assembly and a penetrating end of said accommodating member; and a nail pusher disposed between said fixed magazine and said removable nail loading assembly, and pushed by the pushing device;

wherein the magazine apparatus is disposed on a nail gun main body between a trigger and the barrel.

2. The pushing device of a drawer type magazine apparatus as claimed in claim 1, wherein the fixed magazine includes a guide part for receiving said pushing device and a receiving part for receiving the removable nail loading assembly and the nail pusher.

3. The pushing device of a drawer type magazine apparatus as claimed in claim 2, wherein the receiving part is provided with an inserting part for receiving the nail pusher.

4. The pushing device of a drawer type magazine apparatus as claimed in claim 1 or 2, wherein the removable nail loading assembly includes a cooperating part connected slidablly with the receiving part of the fixed magazine, the accommodating part and the lock hole for accommodating and engaging with the pushing device.

5. The pushing device of a drawer type magazine apparatus as claimed in claim 1, wherein the accommodating member includes an engaging end for engaging with the engaging member and the penetrating end for receiving the fastener.

6. The pushing device of a drawer type magazine apparatus as claimed in claim 1, wherein the spiral spring has a penetrating aperture for receiving the engaging member and a fixing part for engaging with the nail pusher.

7. The pushing device of a drawer type magazine apparatus as claimed in claim 1, wherein the engaging member has locking ends for locking on an engaging end of the accommodating member.

8. The pushing device of a drawer type magazine apparatus as claimed in claim 1, wherein the fastener inserted into the lock hole of the removable nail loading assembly and the penetrating end of the accommodating member.

9. The pushing device of a drawer type magazine apparatus as claimed in claim 1, wherein the nail pusher includes two opposite protrusions for inserting into a inserting part of a receiving part of the fixed magazine and a fixing part of the spiral spring.

* * * * *